US011498707B2

(12) United States Patent
Strauss

(10) Patent No.: US 11,498,707 B2
(45) Date of Patent: Nov. 15, 2022

(54) SYSTEM COMPRISING ALTERNATING FILLING OF CONTAINERS

(71) Applicant: BAUSCH + STRÖBEL MASCHINENFABRIK ILSHOFEN GMBH + CO. KG, Ilshofen (DE)

(72) Inventor: Siegfried Strauss, Feuchtwangen (DE)

(73) Assignee: Bausch + Ströbel Maschinenfabrik Ilshofen GmbH + Co. KG, Ilshofen (DE)

( * ) Notice: Subject to any disclaimer, the term of this patent is extended or adjusted under 35 U.S.C. 154(b) by 753 days.

(21) Appl. No.: 16/304,929

(22) PCT Filed: Mar. 13, 2018

(86) PCT No.: PCT/EP2018/056226
§ 371 (c)(1),
(2) Date: Nov. 27, 2018

(87) PCT Pub. No.: WO2018/167054
PCT Pub. Date: Sep. 20, 2018

(65) Prior Publication Data

US 2021/0221541 A1 Jul. 22, 2021

(30) Foreign Application Priority Data

Mar. 13, 2017 (DE) ..... 10 2017 204 092.0
May 2, 2017 (DE) ..... 10 2017 207 307.1

(51) Int. Cl.
*B65B 3/00* (2006.01)
*B65B 3/04* (2006.01)
(Continued)

(52) U.S. Cl.
CPC ..... *B65B 3/003* (2013.01); *B65B 3/04* (2013.01); *B65B 3/28* (2013.01); *B65B 43/46* (2013.01); *B65B 43/54* (2013.01)

(58) Field of Classification Search
CPC .. B65B 1/32; B65B 3/003; B65B 3/04; B65B 3/28; B65B 43/46; B65B 43/54; B67C 3/202
(Continued)

(56) References Cited

U.S. PATENT DOCUMENTS 4,151,698 A * 5/1979 Muller et al. ..... B65B 3/04 53/282
4,208,852 A * 6/1980 Pioch ..... B65B 3/36 53/282
(Continued)

FOREIGN PATENT DOCUMENTS

DE 3411155 A1 * 10/1985 ..... B65B 3/28
DE 10242118 11/2003
(Continued)

OTHER PUBLICATIONS

German Application No. DE102017207307.1, Search Report dated Dec. 13, 2017, 8 pages.
(Continued)

*Primary Examiner* — Stephen F. Gerrity
(74) *Attorney, Agent, or Firm* — Kilpatrick Townsend & Stockton LLP

(57) ABSTRACT

A system for filling containers, in particular syringes, comprising a multi-track transport device for transporting a plurality of rows of containers in a transport direction; at least two weighing devices, which are arranged in succession in the transport direction; at least one multi-track filling station, wherein the number of tracks of the filling station matches the number of tracks of the transport device; at least one sealing station; means for placing each row of containers on one of the at least two weighing devices; and control configured to actuate the transport device such that each row of containers is placed at a relevant weighing device for a filling process, wherein the row of containers merely passes
(Continued)

by the other weighing devices without being placed at these other weighing devices for a filling process.

19 Claims, 5 Drawing Sheets

(51) Int. Cl.
*B65B 3/28* (2006.01)
*B65B 43/46* (2006.01)
*B65B 43/54* (2006.01)

(58) Field of Classification Search
USPC ..... 53/471, 282, 502, 284.5, 284.6, 299
See application file for complete search history.

(56) References Cited

U.S. PATENT DOCUMENTS

| | | | | |
|---|---|---|---|---|
| 5,148,841 | A | 9/1992 | Graffin | |
| 5,353,850 | A * | 10/1994 | Ueda et al. | B65B 1/06 141/129 |
| 5,819,816 | A * | 10/1998 | Mayer | B65B 3/28 141/83 |
| 5,944,073 | A * | 8/1999 | Klein | B65B 43/54 141/170 |
| 7,069,964 | B1 * | 7/2006 | Kakuda | B65B 3/28 141/165 |
| 2004/0079051 | A1 * | 4/2004 | Lippman et al. | B65B 3/003 53/284.5 |
| 2005/0060962 | A1 * | 3/2005 | Rothbauer | B65B 3/003 53/471 |
| 2006/0151714 | A1 * | 7/2006 | Thilly et al. | B65B 3/003 250/453.11 |
| 2013/0067867 | A1 | 3/2013 | Veile | |
| 2015/0204714 | A1 | 7/2015 | Boehringer et al. | |
| 2018/0162572 | A1 * | 6/2018 | Trilli et al. | B65B 3/003 |
| 2018/0170588 | A1 * | 6/2018 | Boldrini | A24F 40/70 |
| 2018/0186481 | A1 * | 7/2018 | Franke et al. | B65B 3/04 |

FOREIGN PATENT DOCUMENTS

| | | | | |
|---|---|---|---|---|
| DE | 102004035061 | A1 * | 2/2006 | B65B 3/28 |
| DE | 102010043160 | | 5/2012 | |
| DE | 102011082709 | | 3/2013 | |
| DE | 102011113358 | | 3/2013 | |
| DE | 102012212033 | | 1/2014 | |
| DE | 102014214693 | | 1/2016 | |
| DE | 102015215983 | | 2/2017 | |
| EP | 0406092 | | 1/1991 | |
| EP | 2420450 | | 2/2012 | |
| EP | 2832648 | | 2/2015 | |

OTHER PUBLICATIONS

International Application No. PCT/EP2018/056226, International Search Report and Written Opinion dated Apr. 6, 2018, 12 pages (3 pages of English translation and 9 pages of Original document).

* cited by examiner

SYSTEM COMPRISING ALTERNATING FILLING OF CONTAINERS

CROSS-REFERENCE TO RELATED APPLICATIONS

This application is a national phase application of PCT Application No. PCT/EP2018/056226, filed on Mar. 13, 2018, which claims priority to German Application No. DE 102017204092.0, filed on Mar. 13, 2017, and to German Application No. DE 102017207307.1, filed on May 2, 2017, the entire disclosures of which applications are incorporated herein by this reference.

TECHNICAL FIELD

The present invention relates to a system for filling containers, in particular syringes, in particular in the medical and/or pharmacological field, and to an associated method.

BACKGROUND

In the field of medicine and pharmaceuticals, quantities of liquid of a few millilitres or even less are often administered as single doses. In order to prevent contamination and to ensure sufficient sterility, and at the same time to eliminate any errors in dose or measuring out, appropriate agents and drugs are preferably provided in individual containers, each of which accordingly contains the quantity for a single dose.

At the same time, it is essential for the quantity in the container to correspond as precisely as possible to the intended quantity indicated on the container, both in terms of quantity of liquid and also quantity of active ingredient.

Accordingly, a large number of containers need to be filled and sealed in a sterile manner, with deviations from the target filling quantity remaining within a very narrow tolerance range and at the same time with the number of rejects having contents outside the tolerance range being low. This is necessary in particular because, for reasons of sterility, the corresponding container needs to be sealed in a sterile manner as soon as possible after it is filled, and it is then no longer possible to top up said container.

Since accordingly filling said containers by hand is much too time-consuming and labour-intensive, filling systems have been developed in which a plurality of filling needles are arranged in a row, said needles can accordingly fill a plurality of containers arranged in a row, and then a sealing station seals the row of containers in a sterile manner by means of sealing actuators that are arranged in a corresponding row.

Usually, each container in the row of containers is weighed individually before and after the filling process in order to monitor the filling quantity. This may be carried out as a whole row on a corresponding row of scales, or the containers can be individually removed from the row and placed onto an individual set of scales.

Since the containers are stored as filled and sealed containers in nests in which said containers are arranged in rows and columns, both for delivery for filling and during onward transport, the following has become established as a standard method for filling the containers:

- transporting the nest on a transport device towards the system for filling;
- removing a row of containers from the nest;
- placing the row of containers on a row of scales in order to individually weigh each container when empty;
- transporting the containers to the filling station;

- filling the containers;
- transporting the containers to the row of scales in order to weigh the filled containers so as to determine and verify the filling quantity from this gross weight and the earlier tare weight;
- transporting the row of containers to the sealing station;
- sealing the row of containers; and
- inserting the row of containers into the nest.

Since each weighing operation is complex, to accelerate the process often only some of the rows of containers are weighed, for example every $10^{th}$ row or just one row per nest.

In this process, it has been assumed until now that, because of the substantially consistent output from the filling needles, this is sufficient for ensuring a consistent filling quantity. However, this is in fact not an optimal approach, since even small deviations in individual containers are problematic in certain medical products.

In previous methods, however, weighing every individual row and thus individual containers both before and after filling in order to more precisely determine the filling quantity for each individual container leads to insufficient speed and reduced output from the plants. This results in increased costs.

BRIEF DESCRIPTION OF THE DRAWINGS

An embodiment of the invention is described in the following with reference to the drawings, in which.

DESCRIPTION

Figure 1:
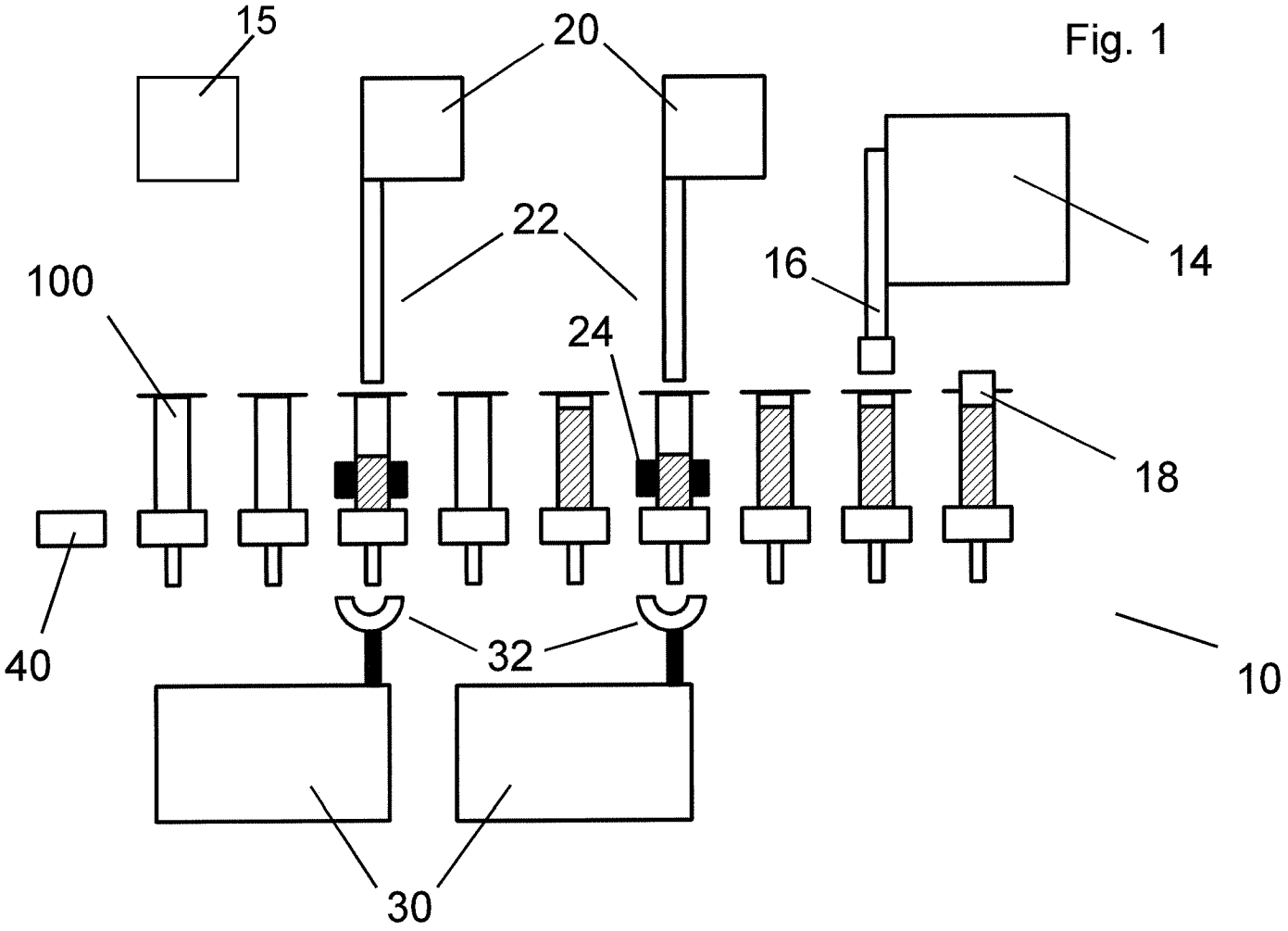
FIG. 1 is a schematic side view of a system according to the invention.

The problem addressed by the present invention is therefore to solve the problems arising in the prior art, in particular to provide a system for filling containers, in particular syringes, in which each container is weighed in the process, i.e. before, during and/or after filling, in particular in that each container is tare-weighed and gross-weighed in order to guarantee that all the containers have been correctly filled. At the same time, a corresponding system needs to operate at a sufficient speed and not at an excessively high cost.

A system according to the invention for filling containers, in particular syringes, comprises:

- a multi-track transport device for transporting a plurality of rows of containers in a transport direction;
- at least two weighing devices (30), which are arranged in succession below the transport device and along the transport device;
- at least one multi-track filling station, wherein the number of tracks of the filling station matches the number of tracks of the transport device, wherein the at least one filling station is designed such that, by means of the at least one filling station, a process of filling rows of containers positioned above and/or at two of the at least two weighing devices can be carried out;

at least one sealing station;

means for placing each row of containers on one of the at least two weighing devices; and control configured to actuate the transport device such that each row of containers is placed above and/or at a weighing device for a filling process, wherein the row of containers merely passes by the other weighing devices without being placed at these other weighing devices for a filling process.

Here, "container" is understood to mean all types of container, but in particular those as used in the medical and/or pharmacological field, for example for liquids. In addition to syringes, containers may in particular also be vials, small bottles, test tubes and/or similar containers, for example, in particular of the type used in the medical and/or pharmacological field.

Here, "multi-track" means that a plurality of containers are always arranged beside one another when viewed in the transport direction. Said containers are generally also substantially in a line with respective containers in a preceding or subsequent row in the transport direction.

"Multi-track" does not however necessarily mean that there are accordingly a plurality of physical tracks, rails or the like extending in the transport direction. This cannot be ruled out, however.

The transport is carried out in the form of rows of containers, such that when the system is started up, a first row of containers is initially arranged, said row is accordingly moved in the transport direction, and then a second row of containers is arranged in the same position as before, and is then likewise moved in the transport direction by the transport device.

The at least one filling station being multi-track means that a plurality of containers arranged beside one another transversely to the transport direction can be filled at the same time. Here, the filling station is designed such that it can simultaneously fill exactly as many containers arranged in rows as are present in the rows of the transport device.

Placing the containers on a weighing device in this case means that the containers are positioned relative to the weighing device such that the weighing device can measure their current weight.

The system according to the invention achieves a sufficiently high output while at the same time gross-weighing and tare-weighing each individual container, namely by providing at least two weighing devices and configuring the control such that the rows of containers stop at just one weighing device each and at the same time move past the other weighing device. Therefore, at each filling stop, during which time-consuming weighing of the containers is generally required, two container rows are weighed at the same time or in quick succession in each case by the respectively provided weighing device as part of the filling process. This speeds up the process as a whole, since the weighing is the most time-consuming part, and so providing two weighing devices and using them in quick succession or in an overlapping manner results in the process being sped up considerably, while at the same time each container can be precisely weighed in order to achieve a high level of product reliability.

The sealing station and the systems for conveying containers to and from the transport device can, however, easily be designed such that they load two rows with containers or remove containers from two rows or seal containers in two rows while the transport device is stopped for the filling process. Either a plurality of filling stations, e.g. one per weighing device, may be provided, or one or more filling stations that can move in the transport direction may be provided. In this way, at least double the throughput can be achieved compared with systems that handle and weigh, fill, weigh and seal a single row at a time in succession. This is because the significant expenditure of time results from the weighing as part of the filling process, which in the present invention is always carried out for at least two rows simultaneously or in quick succession/in an overlapping manner, except for possibly at the start and the end of the operation of the system, when the first row of containers or potentially a final row of containers without a subsequent row is accordingly filled and weighed.

Preferably, the at least one filling station can be moved in the transport direction from a first filling position for a process of filling a row of containers positioned at one of the at least two weighing devices to another filling position for a process of filling a row of containers positioned at another of the at least two weighing devices.

Alternatively or additionally, at least two multi-track filling stations, or more, which are arranged in succession in the transport direction but are not movable in the transport direction are provided. Two or more corresponding, movable filling stations may also be provided which each serve two or more filling positions or rows of containers arranged above a weighing device.

Furthermore, one or more movable filling stations and one or more immovable filling stations may also be provided. Furthermore, when providing a plurality of movable filling stations, some or all of the movable filling stations may also be movable relative to one another. Furthermore, when providing a plurality of movable filling stations, some or all of the movable filling stations may also be designed such that they move synchronously and/or at a fixed distance from one another.

In principle, it applies to all embodiments described herein comprising a plurality of filling stations that are immovable in the transport direction that, in alternative embodiments, fewer filling stations or just one filling station that is/are movable in the transport direction is/are provided or can be used in the otherwise equivalent system/method. In reverse, it applies to all embodiments described herein comprising one or more filling stations that are movable in the transport direction that, in alternative embodiments, more filling stations, in particular one filling station per approaching weighing device, which station is however immovable in the transport direction, is/are provided or can be used in the otherwise equivalent system/method.

Here, movable/immovable relates to movements of the filling station in the transport direction. Irrespective of this, the filling station may comprise parts that are movable with respect to the filling process, e.g. filling needles, or may be movable as a whole.

Furthermore, other elements of the system according to the invention, in particular the at least one sealing station, may also be movable, in particular in the transport direction. In this case, all the features and/or properties mentioned in relation to the movability of the filling stations may also be provided in these other movable elements.

Preferably, the transport device is designed as at least one strip per row of containers. Said strips accordingly extend transversely to the transport direction and are transported by means of a shared drive, for example. Holes into which the containers are inserted for transport are provided in the strips, whereby the number of holes accordingly determines the number of tracks in the system.

Preferably, a strip of this type is designed to have two arms, with one arm on each side of the holes, and is more preferably designed to be hinged. Therefore, when the strip is closed up, the containers are retained by the strip. When the strip is opened out, the containers can be released and therefore their weight can be measured by the corresponding weighing device, because otherwise their weight is actually resting on the strip.

Preferably, the holes are naturally designed such that they retain the corresponding containers solely on account of their shape. For the syringes, this may for example be implemented by conically tapering the hole from the upper face of the strip towards the lower face of the strip. However, the shape may also be step-like, and for other containers, for example test tubes having a rim that projects over the rest of the wall at the upper end, the hole may also be designed to have a completely constant diameter.

In some embodiments, the strip may be designed as a hollow strip, wherein the transport device further comprises strip inserts that can be slid into the hollow strips and in a longitudinal direction of said hollow strips, wherein the strip inserts each have one hole per hole in the hollow strip. The strip inserts may for example be guided/positioned in the interior of the hollow strips by means of rails or grooves.

Depending on the position of the strip insert relative to the hollow strip, the diameter and shape of the passage from the upper face to the lower face of the strip can vary, meaning that containers are either retained or released depending on position. The shape of the strip inserts and/or of the interior of the hollow strip is preferably such that direct or indirect engagement with the container is possible in a retaining position of the strip insert.

Preferably, the shape of the holes in the strip inserts does not match the shape of the holes in the hollow strip, preferably such that there are positions of the strip inserts which cover a region of the passage for the holes in the hollow strip and positions of the strip inserts which leave the passage for the holes in the hollow strip open.

Preferably, the shape of the holes in the strip inserts and/or the hollow strip has a circular or elliptical portion and a portion that differs from the circular or elliptical shape. Preferably, this shape is in particular a semi-circle to a three-quarters circle, and a triangle in the remaining portion that is no longer circular.

In this case, the shape of a hole means in particular the edge contour of the hole when viewed from bottom to top or from top to bottom, based on the strip/strip insert.

Preferably, in all embodiments, the system comprises a centring insert, which can be guided through the holes in the strips due to its shape, wherein the centring insert comprises one end suitable for coupling to the weighing devices and comprises a clamping device at the other end for clamping and/or centring a container.

In variants comprising a strip insert, the shape of the holes therein is accordingly likewise designed based on the centring insert, or vice versa.

As a result, different containers can be retained using standardised hole sizes by the clamping device being designed to be sufficiently flexible.

Preferably, the centring insert comprises a recess and/or a projection, in particular a resilient or resiliently mounted projection for engaging with retaining means inside the strips. Retaining means of this type may be both structures of the strip and also structures of the hollow strip or the strip insert.

Particularly preferable are projections/recesses with which the strip insert engages in a corresponding position and no longer engages in a correspondingly different position such that the centring insert is released in order to rest on a weight sensor of a weighing device.

Since the weight of the centring insert is both known and generally is not involved in gross-weighing and tare-weighing anyway, the filling quantity/fill weight can thus also be reliably determined.

In one variant, the strips are rigidly coupled to a drive device, such that all the strips are accordingly always moved at the same time.

In other variants, it may also be provided that the strips are driven individually or are movable relative to one another in another manner, such that the distance between strips that are in succession in the transport direction can be decreased and increased during transport.

This may be advantageous since for example the sealing station, which for example has to seal two rows of containers during a filling process, does not have to be formed solely by elements that are movable in the transport direction. This is because the two strips at the sealing station and the strips that are following in the transport direction are accordingly advanced in a simple manner so that, during the filling process, two rows of containers reach a position suitable for the sealing process.

Preferably, the system further comprises at least one gripper device per filling station, which is designed to raise and/or lower at least one container or a device retaining the container. As a result, in particular in combination with the ability to open out the strips, or said other mechanisms for retaining the containers directly or indirectly on the strips, the containers can be easily and rapidly placed on the relevant weighing device.

Particularly preferably, in combination with the transport device being designed as strips, the gripper device is designed such that the at least one container or a device retaining said container can be raised out of a hole in the strip and/or can be lowered onto a weight sensor of the weighing device.

This may in particular be provided such that the gripper device is designed to grip all the containers/devices simultaneously while the strip is being opened out or shortly before the strip is opened out.

A plurality of separate gripper devices for gripping all the containers/devices in a row or in a strip may be provided, however.

Alternatively or in addition to a gripper device, the strips may also be designed to be individually movable in a direction that is vertical based on the transport direction. Therefore, the strip can directly carry out the function of accordingly lowering or raising containers or devices.

Alternatively or additionally, the corresponding devices below or above the strips may also be designed to accordingly stop at the containers/devices, e.g. by the weighing devices or corresponding parts thereof being vertically movable.

The features and details relating to the distance of two successive strips may also be applied to individually movable strips, both vertically and in the transport direction, with this being based precisely on a standard distance of successive strips, for example the distance which results when all the strips are arranged in the transport direction with the same distance, or the technically standard distance in the input or output region of the transport device. Therefore, in the preceding and in the following, for variants having strips that are movable relative to one another, "distance" should be understood and interpreted to means a standard distance of this kind, since, when said strips are individually movable, the distance between two specific adjacent strips may also vary, e.g. when using a single, immovable sealing station and individually movable strips in the region of the sealing station.

The distance between two weighing devices that are in succession in the transport direction is preferably such that, when positioning each row of containers at and/or above each of the successive weighing devices, there is either no space for a row of containers therebetween or there is space for a number of rows of containers that is equal to the total number of the filling stations or corresponds to a multiple thereof.

This is because, owing to the forward movement by a certain number of strips and the subsequent stop for filling, it is possible for each row of containers to only be stopped once for a filling process at a weighing device when passing through the transport device. Therefore, the control can be configured particularly simply.

In particular, under these conditions the control can be configured such that it only actuates the transport device in two alternating steps, namely one involving advancing by a number of rows of containers equal to the number of weighing devices and one involving subsequent stoppage for the duration of the filling process and possibly the weighing processes. Control of this type may be mechanical or electromechanical, such that programming errors relating to the control can be eliminated.

Accordingly, the spatial arrangement of the at least two weighing devices in the transport direction is preferably implemented either in said manner or in another manner such that it produces a number such that, in a transport pattern corresponding to a forward movement by this number of rows of containers followed by a filling stop followed by another forward movement by this number of rows of containers, each row of containers is only at a weighing device once at one filling stop and is not at a weighing device at all the other filling stops.

When arranging filling stations that are not movable in the transport direction, i.e. in particular when arranging one filling station per weighing device, the filling stations are preferably likewise designed according to the features mentioned above in relation to the weighing devices, and/or the system is designed to that effect, for example such that the distance between two filling stations is corresponding or such that the control is configured such that one row of containers is only at one filling station during a filling process.

Preferably, each filling station comprises a number of filling needles that is equal to the number of tracks. Likewise, each weighing device preferably comprises a number of weight sensors that is equal to the number of tracks. Likewise, the sealing station preferably comprises a number of sealing actuators for sealing one container at a time that is equal to the number of tracks.

Depending on the number of filling stations, the duration of a filling process, the movability of the sealing stations and sealing actuators and the duration of a sealing process, it may be advantageous to provide more than one sealing station in succession in the transport direction. In this case, it is particularly preferable for one sealing station to be provided for every two filling stations and/or every two weighing devices.

If there is too high a number of filling stations and/or weighing devices and too low a number of sealing stations therefor, the total output of the system may ultimately be limited by the operating speed of the sealing stations. This can be remedied by increasing the number of said stations.

Preferably, the system comprises a nest emptying device at the start of the transport device in order to remove containers from a nest and introduce them into the transport device. Preferably, the system likewise comprises a nest loading device at one end of the transport device in order to remove containers from the transport device and insert them into a nest. These two devices may be designed similarly to the above-described gripper devices.

This is advantageous since corresponding containers in the medical and/or pharmacological field are generally stored in nests and are prepared for various production processes and shipping processes.

The invention also relates to a method for filling containers, in particular using a system according to the invention corresponding to the above-mentioned features, comprising the steps of:

b) arranging empty containers in successive rows, wherein at least two containers are arranged per row;

c) moving the rows in a transport direction; and d) applying one of the following sub-steps to each of the rows:

d1) filling the containers in the row at a first filling point and moving these containers past at least one other filling point without filling;

d2) moving the containers in the row past the first filling point and filling these containers at precisely one of the at least one other filling point.

The steps b), c) and d) are preferably applied to different containers and rows simultaneously, except for the filling according to sub-steps d1) and d2), which are preferably applied alternately or simultaneously to different container rows.

The containers arranged in rows are therefore moved in the transport direction, a plurality of filling points being provided in the transport direction and each row of containers only being filled at one filling point in each case, and passing by the other filling points without being filled. In this case, some of the rows of containers are filled at the first filling point and some are filled at the other filling point(s).

Since other method steps may be applied to two or more rows in the time required for filling and weighing a row, in the method according to the invention, the duration of the filling process and in particular of a weighing process required thereby is no longer the critical time component that limits the total output.

As a result, the output can be doubled or even more than doubled compared with conventional methods, while at the same time a filling process that satisfies standard quality requirements is ensured for each individual container.

Preferably, the method according to the invention further comprises the steps of:

a) removing the empty containers from a nest; and/or e) inserting the filled containers into a nest.

Since containers such as syringes and vials are usually transported and handled in nests in the medical and/or pharmacological field, the connection to standard nest transport systems is ensured thereby.

Preferably, in the step of moving the rows, the method according to the invention comprises the steps of:

c1) moving the rows by a length corresponding to an integer multiple of the distance of two successive rows, wherein the integer multiple is at least two; and c2) stopping the rows for a processing time that corresponds at least to the time required for a filling process.

This directly ensures that, with the distance between the filling points being simultaneously suitably selected, according to step d) each row of containers only stops at precisely the desired filling point for a filling process and is moved past the other filling points.

The same result may also be achieved in an alternative manner, however, by successive rows not always being at the same distance, but instead the distance between successive rows changing in a regular manner according to the distance between the filling points. The forward movement alternating with stopping can then be carried out similarly to steps c1) and c2), but the forward movement then usually corresponds to the length after which the different distances between the rows repeat again.

Preferably, the method according to the invention provides that the fill level and/or the absolute filling quantity are measured, in particular during filling. Alternatively, the containers may also be weighed immediately before filling and immediately after filling is completed.

Owing to a plurality of filling points and to weighing at the relevant filling point, the time for the weighing is likewise no longer critical and a higher throughput can accordingly be achieved, while at the same time ensuring a high level of production reliability by means of tare-weighing and gross-weighing each individual container.

Preferably, the order in which the above-described steps are carried out corresponds to the alphabetical order in which the steps are listed above.

Figure 2B:
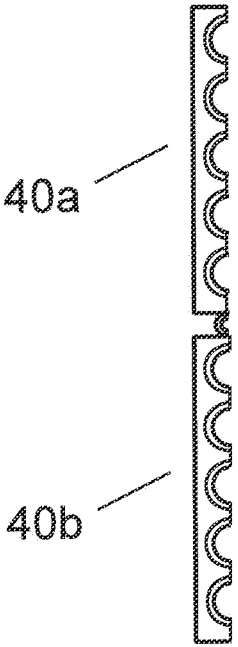
FIGS. 2*a* to 2*c* are schematic views of a closed strip of the system according to the invention, an open strip of the system according to the invention, and a section through the strip of the system according to the invention along the line A-A, respectively.
Figure 2C:
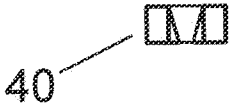
Figure 2A:
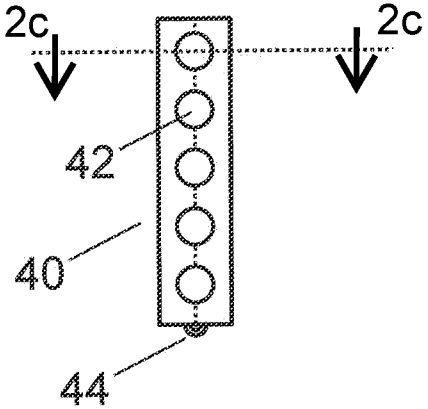
Figure 3:
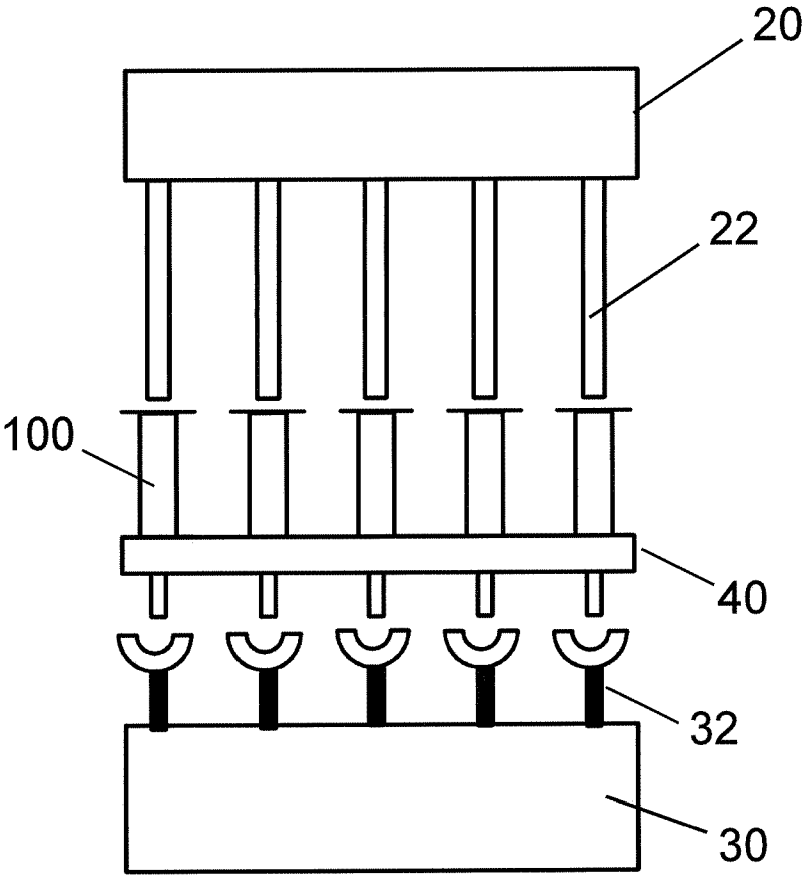
FIG. 3 is a schematic view of the system of FIG. 1 viewed in the transport direction.
Figure 4:
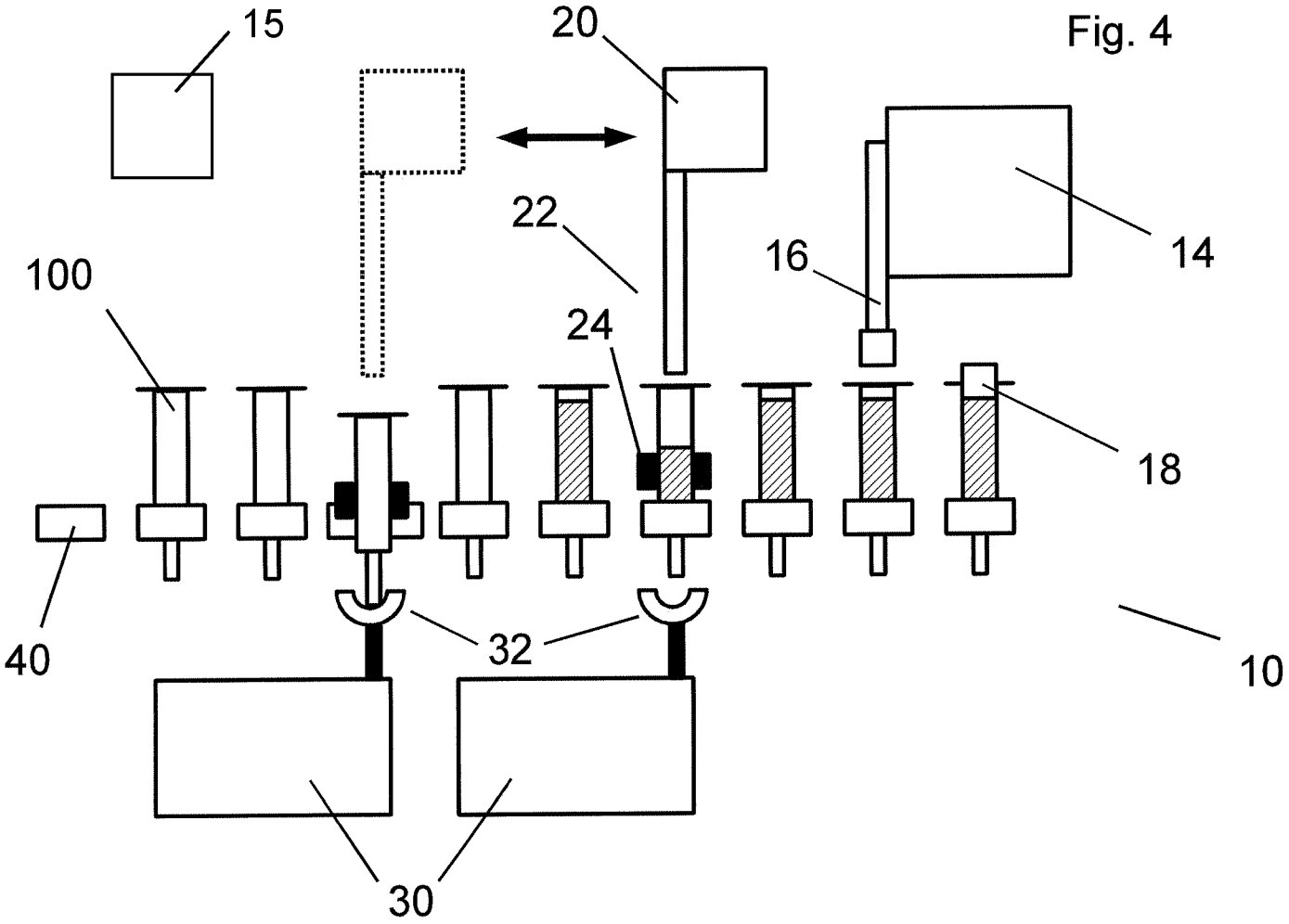
FIG. 4 is a schematic side view of another system according to the invention comprising just one filling station.

An embodiment of the invention is described in the following with reference to the drawings, in which:

FIG. 1 is a schematic side view of a system according to the invention;

FIGS. 2*a* to 2*c* are schematic views of a closed strip of the system according to the invention, an open strip of the system according to the invention, and a section through the strip of the system according to the invention along the line 2*c*-2*c*, respectively;

FIG. 3 is a schematic view of the system from FIG. 1 viewed in the transport direction;

FIG. 4 is a schematic side view of another system according to the invention comprising just one filling station;

FIGS. 5*a* to 5*d* show a schematic view of a hollow strip, a schematic view of a strip insert, a schematic side view of a strip comprising a centring insert, and a schematic plan view of a centring insert, respectively.

An embodiment of the system 10 according to the invention for filling containers 100, which are designed as syringes here by way of example, comprises, as shown in FIG. 1, a transport device formed by means of strips 40, two filling stations 20, two weighing devices 30 and a sealing station 14.

As shown in FIG. 2*a*, a single strip 40 comprises five holes 42, the strip 40 being formed by the arms 40*a* and 40*b*, which are coupled by a hinge 44. As shown in FIG. 2*b*, the arms 40*a* and 40*b* can therefore open out, while in other embodiments the hinge or another appropriate mechanism can be designed such that the arms 40*a* and 40*b* can only open out by a few degrees. Here, an opening angle that is large enough for the containers 100 retained in the holes to be accordingly released is sufficient.

Since the embodiment is designed for syringes that comprise a somewhat thicker region and a somewhat thinner region towards the tip of the syringe, the holes 42 are tapered from top to bottom, as can be seen from the cross section of a hole in FIG. 2*c*, such that, as shown in FIG. 1, the thinner head region of the syringe 100 can project downwards, while the wider upper region cannot pass through the hole and is thus retained.

As can be seen in FIG. 3, five syringes 100 are accordingly retained in each strip 40 and the filling stations 20 accordingly have five filling needles 22 and the weighing device 30 has five weight sensors 32. It is not shown, but the sealing station 14 also accordingly has five sealing actuators 16.

A system could of course also be produced to have a higher or lower number of tracks.

As can also be seen in FIG. 1, the strips 40 are supplied from the left so as to be empty, and syringes 100 are inserted into the holes 42 in the strips 40.

In the present embodiment, the control 15 is configured such that the transport device and the strips 40 are each moved forward by two strip distances, and are then stopped for a filling process.

This figure shows the moment at which the syringes 100 located at the filling stations 20 have already been half-filled by the filling needles 22. Here, the syringes 100 are retained by gripper devices 24.

When the filling process shown is completed, the syringes 100 located at the filling stations 20 have been filled to the extent shown by the shaded area on the syringes located further to the right.

At the end of the filling process, the strips 40 retaining the already filled syringes 100 are opened, at which point the syringes 100 additionally retained by the gripper devices 24 are lowered onto the weight sensors 32 of the weighing devices 30, in order to determine the gross weight of each individual syringe. Since the tare weight has already been determined previously in a similar way, the precise fill level or filling quantity is therefore known for each syringe.

In alternative embodiments, the syringes 100 may also remain on the weight sensors 32 during the filling process, such that the weight is continuously measured and the difference between the starting weight and the current or final weight accordingly serves as a control of the filling quantity.

During the filling and/or the weighing, the sealing actuators 16 of the sealing station 14 will have also provided the syringes 100 that are currently located immediately below the sealing actuator 16 in FIG. 1 with a stopper or seal 18, as is already the case for the syringes 100 on the far right.

Even if, in the present embodiments shown, a movable sealing station 14 or sealing actuators 16 are taken as a starting point instead, one or more immovable sealing stations 40 may alternatively also be used, for example by two sealing stations 14 being provided in succession in the transport direction and/or by the strips 40 being rendered movable relative to one another. In the latter case, exactly when two rows of syringes 100 were being filled, the strips 40 in the vicinity of the sealing station 14 would be moved such that two rows of syringes 100 are positioned in succession for sealing at the sealing station 14. For this purpose, the distance between the strips 40 and/or between the rear filling position would have to be suitably selected as required such that there is sufficient clearance for the individual movement of the strips 40.

The gripper devices 24 then raise the syringes again such that the associated strips 40 can be sealed, and the gripper devices 24 are then released from the syringes 100 such that the gripper devices 24 do not impede the subsequent forward movement of the strips 40 to the right.

Here, the control 15 is configured such that strips 40 are moved forward by the distance of two adjacent strips, and the strips are then stopped for the time required for weighing and filling and are subsequently moved forward again by two strip distances.

As shown in FIG. 1, this means that, once the filling of the syringes 100 that are currently being filled in FIG. 1 is complete, the gripper devices 24 are accordingly released and moved away, at which point the strips 40 move precisely far enough that they adopt the position that is further on by two strip distances in FIG. 1.

Therefore, the syringes 100 on the far left are brought to a stop directly under the filling needles 22 of the first filling station 20. The second syringes 100 from the left are brought to a stop in the first position downstream of the first filling station 20. The syringes 100 that have just been filled by the first filling station 20 are brought to a stop, as completely filled syringes, in a position upstream of the second filling station 20, and the syringes 100 that were previously still empty and were located in the first position downstream of the first filling station 20 are brought to a stop under the second filling station 20. The filled syringes 100 that were previously in a position upstream of the second filling station 20 are now brought to a stop in a position downstream of the filling station 20.

The syringes that are being filled by the second filling station 20 and the filled syringes that were previously in a position downstream of the second filling station 20 are brought into the region which is accessible to the movably operating sealing station as part of the sealing processes. The filled and then also sealed syringes 100 on the far right in FIG. 1 are transported away to the right, based on FIG. 1, and from there are e.g. supplied to a device that removes the syringes 100 from the strips 40 and inserts the syringes 100 into accordingly prepared nests.

The grippers 24 then grip the empty syringes 100 that are currently positioned under the filling stations 20, these syringes are then accordingly transported to tare weighing, i.e. weighing without any contents, and are then transported into a corresponding position suitable for filling, at which point the situation shown in FIG. 1 arises again as part of the following filling process.

The system thus carries out multi-track and alternating dual-row filling, with complete fill weight determination, for example by tare weighing and gross weighing the objects to be filled, for example syringes, vials or cartridges, being achieved at full machine capacity.

As shown in FIG. 1, three strip distances present a possible solution as a distance between the two filling stations 20 and weighing devices 30 when there are two filling stations 20 and two weighing devices 30. Alternatively, purely taking into account the operating principle, the two filling stations 20 and weighing devices 30 could also fill directly adjacent strips, even if one forward movement by two strip distances were possible with the accordingly desired result. However, this might often technically be unsuccessful because corresponding filling stations 20 and weighing devices 30 take up too much space to be effectively positioned closely beside one another.

If more than two filling stations are intended to be used, these may either fill respectively adjacent rows and may be positioned accordingly (again presenting the problem whereby many filling systems are too bulky for this purpose), or the filling stations 20 need to be arranged at a different distance to that in FIG. 1.

In order for it to be possible to produce the pattern from forward movement by a certain number of strip distances, subsequent stoppage and then forward movement again, it is advantageous for the number of strips between two strips under adjacent filling stations 20 and weighing devices 30 to be equal to the total number of filling stations 20 and weighing devices 30. Then, when a forward movement takes place by the number of strips amounting to the total number of filling stations 20 and weighing devices 30, each strip is only below a filling station 20 and above a weighing device 30 once during the stoppage, and otherwise it is always within the distances between two adjacent filling stations 20 or weighing devices 30 during the stoppage.

In other words, the forward movement must=F strip distances, where F=number of filling stations, while the distance between two adjacent filling stations or weighing devices 30 must be equal to F+1 strip distances. Then, by simply changing the forward movement by the corresponding length and stoppage, it is possible for a particular strip to only come to be below a filling station 20 and above a weighing device 30 once during the stoppage as it passes along the entire length of the transport device. Therefore, the capacity of the filling stations 20 and weighing devices 30 is fully utilised.

This is however merely the preferred method, because in principle other distances of the filling stations can also be implemented using more complex actuating systems, in particular with individually movable strips. This merely addresses the control-related problem of how to actuate the strips such that each strip is only below a filling station once during a stoppage for filling processes, and during all other stoppages is not below a filling station, such that each filling station always has empty containers to fill in each stoppage.

Since the process of weighing is in principle the particularly time-critical component, i.e. the process that takes the most time, filling stations 20 that are movable in the transport direction may also be provided instead of one filling station 20 per weighing device 30.

An embodiment of this type comprising one movable filling station 20 and two weighing devices 30 is shown in FIG. 4.

This merely differs from that shown in FIG. 1 relating to the configuration of the control 15 in that one filling station 20 fills a row of containers 100 on/above a weighing device 30, while for example for the other row of containers 100 positioned on a weighing device 30 the strip 40 has been opened and moved away, and the containers 40 have been lowered onto the weight sensors 32 and tare weighing is then carried out.

The gross weighing of the containers 100 that have just been filled takes place in the same manner, while the filling station 20 moves in the direction of the arrow to the row of containers 100 that have just been tare-weighed, in order to fill these containers once they have been suitably raised by the gripper 24. Otherwise, the system 10 in FIG. 4 operates in a similar manner to that in FIG. 1, and also has accordingly configured control.

Since the weighing lasts considerably longer than the moving and filling, the system according to FIG. 4 is similarly as rapid as that shown in FIG. 1, since the critical time component of the weighing primarily becomes less significant due to the two weighing devices 30.

Figure 5C:
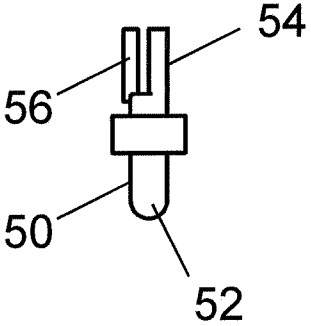
FIGS. 5*a* to 5*d* show a schematic view of a hollow strip, a schematic view of a strip insert, a schematic side view of a strip comprising a centring insert, and a schematic plan view of a centring insert, respectively.
Figure 5B:
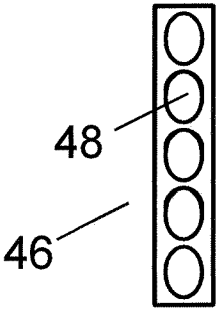
Figure 5D:
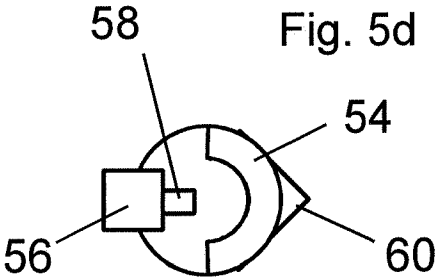
Figure 5A:
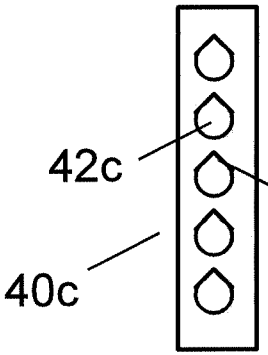

FIGS. 5*a* and 5*b* show another possible design of the strips 40*c*. Said strips are designed as hollow strips 40*c*, and strip inserts 46 are also provided which can be slid into the interior of the hollow strips 40*c* or are at least movably arranged therein.

The holes 42*c*, 42*d* in the hollow strip 40*c* have a circular portion 42*c* and a triangular portion 42*d* in this case. The holes 48 in the strip inserts 46 are elliptical, however.

Furthermore, the system 10 or the transport device comprises centring inserts 50 as shown in FIGS. 5*c* and 5*d*, comprising a lower end 52 suitable for being positioned so as to be coupled to a weight sensor 32; the shape of this end 52 therefore being determined by the design of the weight sensors 32, and vice versa.

Furthermore, on an upper end, the centring insert 50 comprises a clamping device 54, 56, comprising a clamp bracket 54 and a clamping block 56 that is resiliently movably mounted in a guide recess 58 towards said bracket, between which clamping bracket and clamping block container ends of containers 100 can be clamped or centred.

The shape of the centring inserts 50 between the two ends substantially corresponds in this case to a circle, a triangular projection 60 being provided at a suitable height such that the shape as a whole is suitable for passing through the holes 42*c*, 42*d* in the hollow strip 40*c*.

Depending on the position of the strip insert 46, the centring insert 50 can thus either be released or retained in the downward direction.

If, for example, based on FIGS. 5*a* and 5*b*, the strip insert 46 is slid in the hollow strip 40*c*, but relatively far down, the region of the strip insert 46 positioned above the elliptical holes 48 blocks the triangular portion 42*d* of each of the holes 42*c*, 42*d*. Therefore, the projection 60 rests on the strip insert 46 and is retained by the hollow strip 40*c* due to the coupling of the strip insert 46 in the hollow strip 40*c*.

If, for example, based on FIGS. 5*a* and 5*b*, the strip insert 46 is slid in the hollow strip 40*c*, but relatively far up, no region of the strip insert 46 blocks the holes 42*c*, 42*d* in the hollow strip 40*c*. Owing to the appropriate shape, a centring insert 50 positioned in a hole 42*c*, 42*d* is no longer blocked in the downward direction and can rest its full weight e.g. on the weight sensor 32 located below the strip.

Once the weighing is complete, the strip insert 46 can be moved again by slightly raising the centring inserts 50 as required by means of the grippers 24, for example, so that the centring insert 50 is retained by the hollow strip 40*c* again.

In this way, on one hand the weighing process can be carried out in a technically simple manner, and on the other hand containers 100 having different diameters of the centring insert 50 can be clamped and therefore retained by the hollow strips 40*c*.

Of course, other shapes of the holes 42*c*, 42*d*, the holes 48 and the centring inserts 50 may produce a corresponding connection, since it is sufficient here for part of the cross section of the holes 42*c*, 42*d* to be blocked in one position of the strip insert 46 and for no region to be blocked in another position.

Alternatively or additionally, the centring insert 50 may also comprise, in addition to the projection 60, movable components that project above the strip 40 or hollow strip 40*c*, for example, and are moved accordingly for the purpose of releasing.

In principle, the two embodiments shown may also be designed without a gripper or gripper device 24. Since said gripper or gripper device essentially serves the function of lowering/raising the containers 100 onto/from the weight sensors 32, alternatively and/or additionally the strips 40 and/or the weight sensors 32 may be vertically movable individually or jointly.

In this case, before a strip 40 is opened or before release by moving a strip insert 46, the strip 40 is suitably lowered and/or the corresponding weight sensors 32 are suitably raised such that the containers 100 rest their weight directly on the weight sensors 32.

The strip 40 is then closed again or the strip insert 46 is suitably moved for blocking. For this purpose, the strip 40 and/or the weight sensors 32 can still be moved slightly in order to provide optimal relative positioning between containers 100 or centring inserts 50 or strips 40 and/or strip inserts 46 for the purpose of engagement.

The invention claimed is:

1. A system for filling containers, comprising:

a multi-track transport device for transporting a plurality of rows of containers in a transport direction;

at least two weighing devices arranged in succession below the multi-track transport device and along the multi-track transport device;

at least one multi-track filling station, wherein a number of tracks of the multi-track filling station matches a number of tracks of the multi-track transport device, wherein the at least one filling station is configured to perform a process of filling rows of containers positioned above or at two of the at least two weighing devices;

at least one sealing station, at least one gripper device configured to place each row of containers on a respective one of the at least two weighing devices; and a control configured to actuate the at least one gripper device and the multi-track transport device such that each row of containers is placed above or at a respective weighing device for a filling process, wherein the row of containers passes by the other weighing devices without being placed above or at these other weighing devices for any filling process.

2. The system of claim 1, wherein the at least one filling station can be moved in the transport direction from a first filling position for a process of filling a row of containers positioned at one of the at least two weighing devices to another filling position for a process of filling a row of containers positioned at another of the at least two weighing devices.

3. The system of claim 1, wherein the system comprises at least two multi-track filling stations arranged in succession in the transport direction, wherein at least one of the filling stations is movable relative to another one of the filling stations.

4. The system of claim 1, wherein the multi-track transport device comprises at least one strip per row of containers, each strip having one through-hole per track or container in a row of containers.

5. The system of claim 4, wherein the strip has two arms, with one arm on each side of the holes, and wherein the strip is hinged.

6. The system of claim 4, wherein the holes are conical and taper from an upper face of the strip towards a lower face of the strip.

7. The system of claim 4, wherein the strip is a hollow strip, wherein the multi-track transport device further comprises one or more strip inserts that can be slid into the hollow strips and in a longitudinal direction of said hollow strip, wherein the strip inserts each have one hole per hole in the hollow strip.

8. The system of claim 7, wherein a shape of the holes in the strip inserts does not match a shape of the holes in the hollow strip, such that there are positions of the strip inserts which cover a region of a passage for the holes in the hollow strip and positions of the strip inserts which leave the passage for the holes in the hollow strip open.

9. The system of claim 7, wherein a shape of the holes has a circular or elliptical portion and a portion that differs from the circular or elliptical shape.

10. The system of claim 7, further comprising at least one centring insert, which can be guided through the holes in the strips due to its shape, wherein the centring insert comprises one end suitable for coupling to the weighing devices and comprises a clamping device at the other end for clamping or centring a container.

11. The system of claim 10, wherein the centring insert comprises a resilient or resiliently mounted projection for engaging with retaining means inside the strips.

12. The system of claim 4, wherein the strips are movable relative to one another, such that a distance between strips that are in succession in the transport direction can be decreased and increased during transport.

13. The system of claim 4, wherein the at least one gripper device comprises at least one gripper device per filling station, which is designed to raise and/or lower at least one container, wherein the at least one gripper device is designed such that the at least one container can be raised from a hole in the strip and/or lowered onto a weight sensor of the weighing device.

14. The system of claim 1, wherein a distance between two weighing devices of the at least two weighing devices that are in succession in the transport direction is such that, when positioning each row of containers at or above each of the successive weighing devices, there is either no space for a row of containers between said rows of containers or there is space for a number of rows of containers that is equal to a total number of the at least two weighing devices or corresponds to a multiple thereof.

15. The system of claim 1, wherein a spatial arrangement of the at least two weighing devices in the transport direction is such that it produces a number such that, in a transport pattern corresponding to a forward movement by this number of rows of containers followed by a filling stop followed by another forward movement by this number of rows of containers, each row of containers is only positioned at one of the weighing devices once at one filling stop and is not positioned at one of the weighing devices at all the other filling stops.

16. The system of claim 1, wherein each filling station has a number of filling needles that is equal to the number of tracks.

17. The system of claim 1, wherein more than one sealing station is provided, and wherein there is one sealing station for every two of the at least two weighing devices.

18. The system of claim 1, wherein the multi-track transport device is configured to receive containers and introduce them into the multi-track transport device.

19. The system of claim 1, wherein the containers comprise syringes.

* * * * *